US008151407B2

(12) United States Patent
Conrad

(10) Patent No.: US 8,151,407 B2
(45) Date of Patent: Apr. 10, 2012

(54) SURFACE CLEANING APPARATUS WITH ENLARGED DIRT COLLECTION CHAMBER

(75) Inventor: Wayne Ernest Conrad, Hampton (CA)

(73) Assignee: G.B.D. Corp, Nassau (BS)

( * ) Notice: Subject to any disclaimer, the term of this patent is extended or adjusted under 35 U.S.C. 154(b) by 1131 days.

(21) Appl. No.: 11/953,246

(22) Filed: Dec. 10, 2007

(65) Prior Publication Data

US 2008/0216282 A1 Sep. 11, 2008

Related U.S. Application Data

(60) Provisional application No. 60/893,990, filed on Mar. 9, 2007, provisional application No. 60/896,586, filed on Mar. 23, 2007, provisional application No. 60/894,005, filed on Mar. 9, 2007.

(51) Int. Cl.
*A47L 5/00* (2006.01)
*A47L 9/10* (2006.01)

(52) U.S. Cl. ..... 15/327.2; 15/327.5; 15/327.6; 15/327.7; 15/347; 15/352; 15/353; 15/410

(58) Field of Classification Search ..... 15/347, 15/352, 353, 327.2, 327.5, 327.6, 327.7, 15/410; *A47L 5/00, 9/10*
See application file for complete search history.

(56) References Cited

U.S. PATENT DOCUMENTS

| | | | | |
|---|---|---|---|---|
| 3,320,727 | A | 5/1967 | Farley et al. | |
| 3,543,325 | A | 12/1970 | Hamrick et al. | |
| 4,523,936 | A | 6/1985 | Disanza, Jr. | |
| 5,129,125 | A | 7/1992 | Gamou et al. | |
| 5,287,591 | A | 2/1994 | Rench et al. | |
| 5,307,538 | A | 5/1994 | Rench et al. | |
| 5,363,535 | A | 11/1994 | Rench et al. | |
| 6,210,469 | B1 | 4/2001 | Tokar | |
| 6,228,260 | B1 | 5/2001 | Conrad et al. | |
| 6,502,278 | B2 * | 1/2003 | Oh et al. | 15/353 |
| 6,732,403 | B2 * | 5/2004 | Moore et al. | 15/339 |
| 6,810,558 | B2 | 11/2004 | Lee | |
| 7,485,164 | B2 | 2/2009 | Jeong et al. | |
| 2005/0252180 | A1 | 11/2005 | Oh et al. | |

(Continued)

FOREIGN PATENT DOCUMENTS

EP 0489498 A1 6/1992

OTHER PUBLICATIONS

Office Action, dated Jul. 7, 2010, for Canadian Patent Application No. 2,675,714.

(Continued)

*Primary Examiner* — David Redding
(74) *Attorney, Agent, or Firm* — Bereskin & Parr LLP/S.E.N.C.R.L., s.r.l.; Philip C. Mendes da Costa

(57) ABSTRACT

A surface cleaning apparatus is disclosed. The surface cleaning apparatus comprises a dirt inlet, a clean air outlet and a fluid flow path extending between the dirt inlet and the clean air outlet. The surface cleaning apparatus further comprises first and second side by side housings. The first housing comprises a cyclonic cleaning stage in the fluid flow path. The cyclonic cleaning stage comprises a cyclone having a dirt outlet. An associated dirt collection chamber is positioned below the dirt outlet. The dirt collection chamber extends under at least a portion of the first and second housings. The surface cleaning apparatus further comprises a fluid flow motor in the fluid flow path.

21 Claims, 9 Drawing Sheets

U.S. PATENT DOCUMENTS

| | | | |
|---|---|---|---|
| 2006/0123590 | A1 | 6/2006 | Fester et al. |
| 2006/0207055 | A1 | 9/2006 | Ivarsson et al. |

OTHER PUBLICATIONS

International Search Report, dated Apr. 21, 2008, for International application No. PCT/CA2007/002211.

Written Opinion, dated Apr. 21, 2008, for International application No. PCT/CA2007/002211.

United States Office Action, dated Feb. 16, 2011, for U.S. Appl. No. 11/953,292.

United States Office Action, dated Jul. 22, 2010, for U.S. Appl. No. 11/953,292.

* cited by examiner

SURFACE CLEANING APPARATUS WITH ENLARGED DIRT COLLECTION CHAMBER

CROSS REFERENCES TO RELATED APPLICATIONS

This application claims priority from U.S. Provisional Patent Applications 60/893,990 (filed on Mar. 9, 2007), 60/896,586 (filed on Dec. 12, 2006), and 60/894,005 (filed on Mar. 9, 2007), which are incorporated herein by reference in their entirety.

FIELD

This application relates to surface cleaning apparatus such as vacuum cleaners and wet/dry vacuum cleaners, which have a dirt collection chamber having enhanced dirt collection capacity.

BACKGROUND

Cyclonic vacuum cleaners have been developed that utilize one or more cyclonic cleaning stages. Each cyclonic cleaning stage may have its own dirt collection chamber. Cyclonic vacuum cleaners that have a cyclonic cleaning stage comprising a plurality of cyclones in parallel are also known. Such cleaning stages may have a dirt collection chamber for each cyclone, or a single common dirt collection chamber for all of the cyclones in the stage.

One such vacuum cleaner is described in United States Patent Application Publication 2006/0123590, to Fester et al., which discloses an upright cyclonic vacuum cleaner comprising two cyclonic cleaning stages in series. The first cyclonic cleaning stage comprises a single cyclone and a second cyclonic cleaning stage comprises a plurality of cyclones in parallel arranged annularly around the first cyclonic cleaning stage. A dirt bin is disposed beneath the first cyclonic cleaning stage, and extends under the second cyclonic cleaning stage. The suction motor is below the cyclonic cleaning stages.

SUMMARY

In one broad aspect, the present invention comprises a surface cleaning apparatus having components that are laterally spaced apart, thereby increasing the size of the footprint of the surface cleaning apparatus compared to the footprint that would be obtained if the components were stacked on top of each other, as is typically the case for upright vacuum cleaners. The surface cleaning apparatus has a cyclonic cleaning stage and an associated dirt collection bin wherein the dirt collection bin extends laterally to utilize part of the footprint of the surface cleaning apparatus. Accordingly, the dirt collection bin has a larger cross sectional area then the cross sectional area cyclonic cleaning stage. The cyclonic cleaning stage preferably comprises a single cyclone. One advantage of this construction is that amount of dirt or water that may be collected in the dirt collection bin is increased. In addition, a further advantage is that the dirt collection efficiency of the surface cleaning apparatus may be enhanced.

In one embodiment, the surface cleaning apparatus comprises a dirt inlet, a clean air outlet and a fluid flow path extending between the dirt inlet and the clean air outlet. The surface cleaning apparatus further comprises first and second side-by-side housings. The first housing comprises a cyclonic cleaning stage in the fluid flow path. The cyclonic cleaning stage comprises a cyclone having a dirt outlet. An associated dirt collection chamber is positioned below the dirt outlet.

The dirt collection chamber extends under at least a portion of the first and second housings. The surface cleaning apparatus further comprises a fluid flow motor in the fluid flow path.

The housings may be a molded plastic casing the surrounds one or more components of the surface cleaning apparatus. Alternately, the housing may be a components of the surface cleaning apparatus, such as a cyclone chamber. In some embodiments, there may be more then two housings. The dirt collection chamber may be positioned under all or part of two or more of the housings. In some embodiments, the dirt collection chamber may be a base of the surface cleaning apparatus. For example, the dirt collection chamber may be provided with wheels, glides or the like, or mounted on a wheeled or slideable cradle, so as to enable the surface cleaning apparatus to be moved over a floor or other surface. Such embodiments are particularly suitable for use with wet/dry vacuum cleaners, such as those known as Shop Vacs.

In accordance with one aspect of the present invention, there is provided a surface cleaning apparatus comprising:

(a) a dirt inlet, a clean air outlet and a fluid flow path extending between the dirt inlet and the clean air outlet;

(b) first and second side by side housings, the first housing comprising a cyclonic cleaning stage in the fluid flow path comprising a cyclone having a dirt outlet;

(c) an associated dirt collection chamber positioned below the dirt outlet, the dirt collection chamber extending under at least a portion of the first and second housings; and, (d) a fluid flow motor in the fluid flow path.

In some embodiments, the dirt collection chamber extends under at least half of the second housing. In a further embodiment, the dirt collection chamber extends essentially under all of the second housing and essentially under all of the first housing. In some embodiments, it will be appreciated that the dirt collection chamber may extend under only part of each housing.

In some embodiments, when the first housing extends vertically, a horizontal cross section of the dirt collection chamber has a cross sectional area that is larger then a horizontal cross section of the first housing.

In some embodiments, the second housing houses at least one member selected from the group comprising at least one additional cleaning stage and the fluid flow motor. In a further embodiment the at least one additional cleaning stage comprises at plurality of cyclones.

In some embodiments, the surface cleaning apparatus further comprises a third housing that houses the motor.

In some embodiments, the first housing houses at least an additional cyclonic cleaning stage, and at least one of the cyclonic cleaning stage and the additional cyclonic cleaning stage comprises a plurality of cyclones in parallel.

In some embodiments, each of the first and second housings have an outer wall and the outer wall of at least one of the housings comprises a wall of a cyclone.

In some embodiments, the first and second housings have a common wall.

In some embodiments, the first and second housings are integrally molded.

In some embodiments, the dirt collection chamber has a door that is openable. In a further embodiment, the door comprises a floor of the dirt collection chamber and the floor is pivotally mounted to at least one of the first and second housings.

In some embodiments, the surface cleaning apparatus further comprises a divider plate positioned adjacent the dirt outlet of the cyclone. In a further embodiment, the dirt collection chamber has a floor that is openable and the divider plate is mounted to the floor. Alternately, the divider plate may be mounted to an upper portion of a sidewall of the dirt collection chamber of a top wall of the dirt collection chamber.

In some embodiments, the cyclonic cleaning stage comprises a single cyclone having the dirt outlet, a plate positioned in the dirt collection chamber adjacent the dirt outlet of the cyclone, and the dirt collection chamber has an openable door.

In some embodiments, the surface cleaning apparatus comprises a hand or strap carryable vacuum cleaner.

In some embodiments, the first and second housings are laterally spaced apart.

In another broad aspect, the present invention comprises a surface cleaning apparatus. The surface cleaning apparatus comprises a dirt inlet, a clean air outlet, and a fluid flow path extending between the dirt inlet and the clean air outlet. A fluid flow motor is in the fluid flow path. A cyclonic cleaning stage is in the fluid flow path and is laterally spaced from the fluid flow motor. The cyclonic cleaning stage comprises a cyclone having a dirt outlet. An associated dirt collection chamber is positioned below the dirt outlet and extends under at least a portion of the fluid flow motor.

In accordance with this broad aspect, there is provided a surface cleaning apparatus comprising:

(a) a dirt inlet, a clean air outlet, and a fluid flow path extending between the dirt inlet and the clean air outlet;
(b) a fluid flow motor in the fluid flow path;
(c) a cyclonic cleaning stage in the fluid flow path and laterally spaced from the fluid flow motor, the cyclonic cleaning stage comprising a cyclone having a dirt outlet; and,
(d) an associated dirt collection chamber positioned below the dirt outlet and extending under at least a portion of the fluid flow motor.

In some embodiments, the dirt collection chamber extends essentially under at least all of the fluid flow motor.

In some embodiments, the dirt collection chamber has a door that is openable.

In some embodiments, the surface cleaning apparatus further comprises another cyclonic cleaning stage comprising a plurality of cyclones in parallel.

In some embodiments, the cyclonic cleaning stage is housed in a first housing and the fluid flow motor is housed in a second housing.

In some embodiments, the surface cleaning apparatus comprises another cyclonic cleaning stage positioned above the cyclonic cleaning stage and comprising a plurality of cyclones in parallel.

In some embodiments, the surface cleaning apparatus is one of a hand or strap carryable vacuum cleaner.

In any of these embodiments, the fluid flow motor is preferably provided in one of the housings and, more preferably, is aligned in the same direction as the cyclone. In accordance with such an embodiment, the fluid flow motor has an inlet end (e.g., a suction fan) and a motor extending longitudinally therefrom. The longitudinal direction is preferably generally parallel to the longitudinal axis of the cyclonic cleaning stage.

Other aspects and features of the present specification will become apparent, to those ordinarily skilled in the art, upon review of the following description of the specific examples of the specification.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Figure 1:
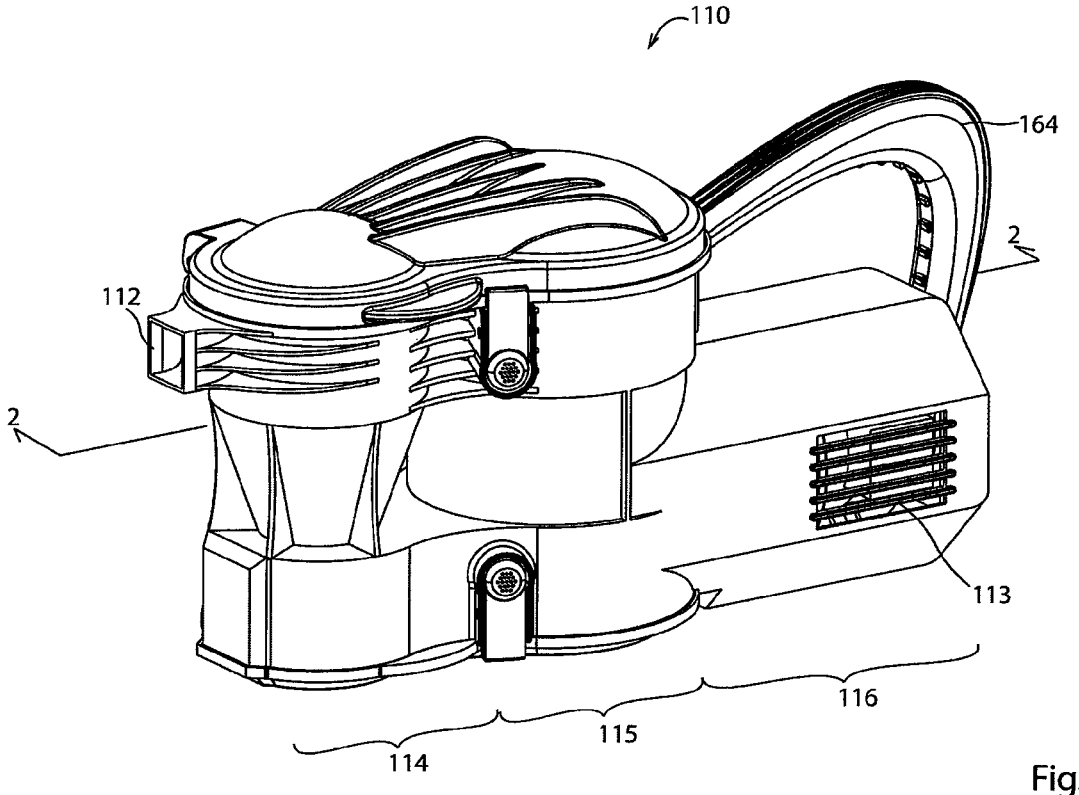
FIG. 1 is a perspective view of an example of a surface cleaning apparatus in accordance with the instant invention.

Embodiments of a surface cleaning apparatus 110 of the present invention are shown in FIGS. 1-9. As exemplified FIGS. 1-6, the surface cleaning apparatus 110 may be a hand vacuum cleaner, which may be converted to a shoulder strap vacuum cleaner by the addition of a shoulder strap (not shown). Alternatively, as exemplified in FIGS. 7-9, the surface cleaning apparatus 110 may be a shop-vac type vacuum cleaner. In other embodiments, the surface cleaning apparatus may be another type of apparatus, such as an upright vacuum cleaner, a canister type vacuum cleaner, a stick vacuum cleaner, a back pack vacuum cleaner, a carpet extractor or the like. The surface cleaning apparatus 110 comprises a dirt inlet 112, a clean air outlet 113, and a fluid flow path extending therebetween. First and second laterally spaced apart components or housings 114 and 115, are disposed in fluid communication with the fluid flow path. The surface cleaning apparatus comprises a fluid flow motor 130, for drawing air from the dirt inlet 112 to the clean air outlet 113.

Figure 2:
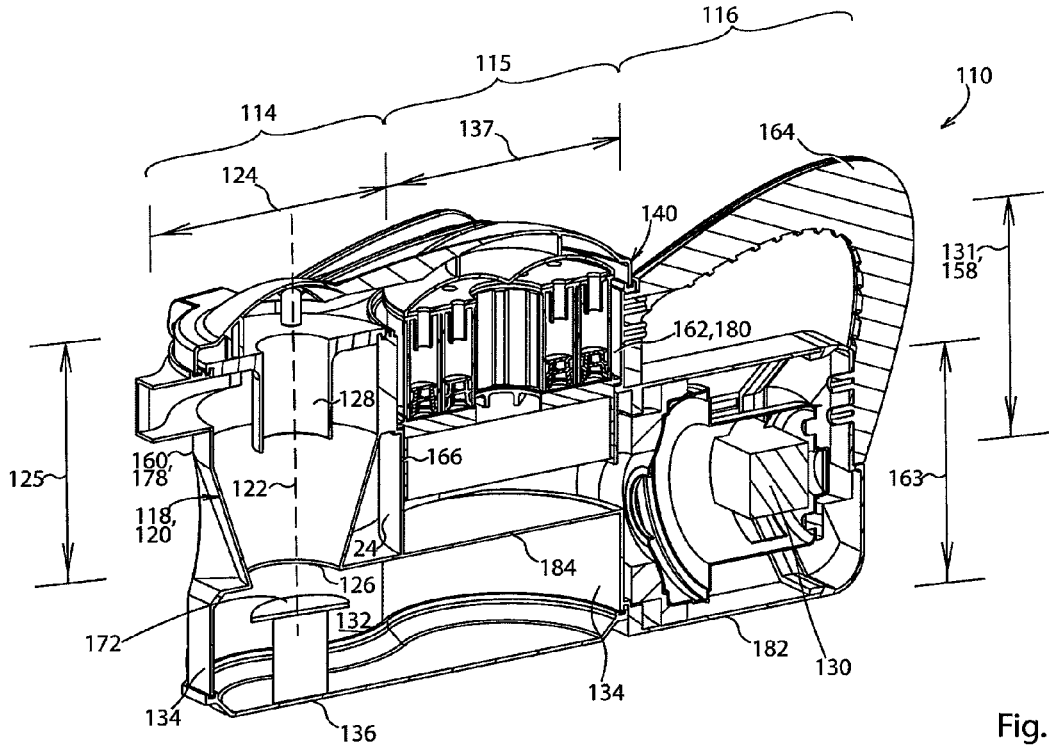
FIG. 2 is a section view of the apparatus of FIG. 1 taken along the line 2-2.
Figure 6:
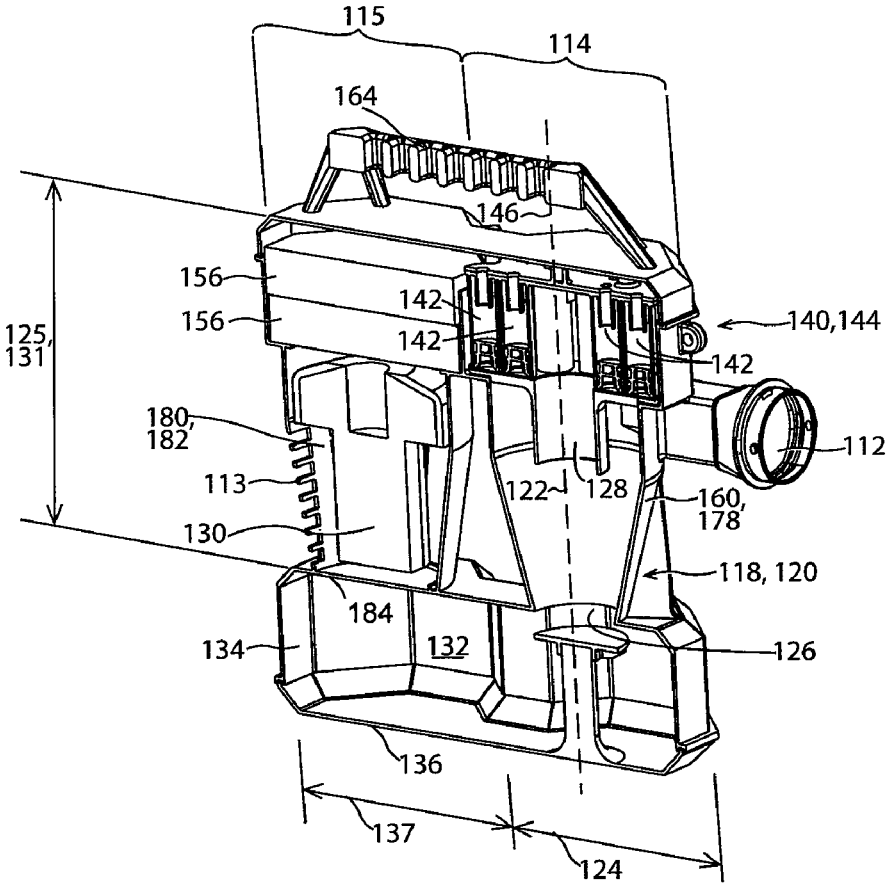
Figure 8:
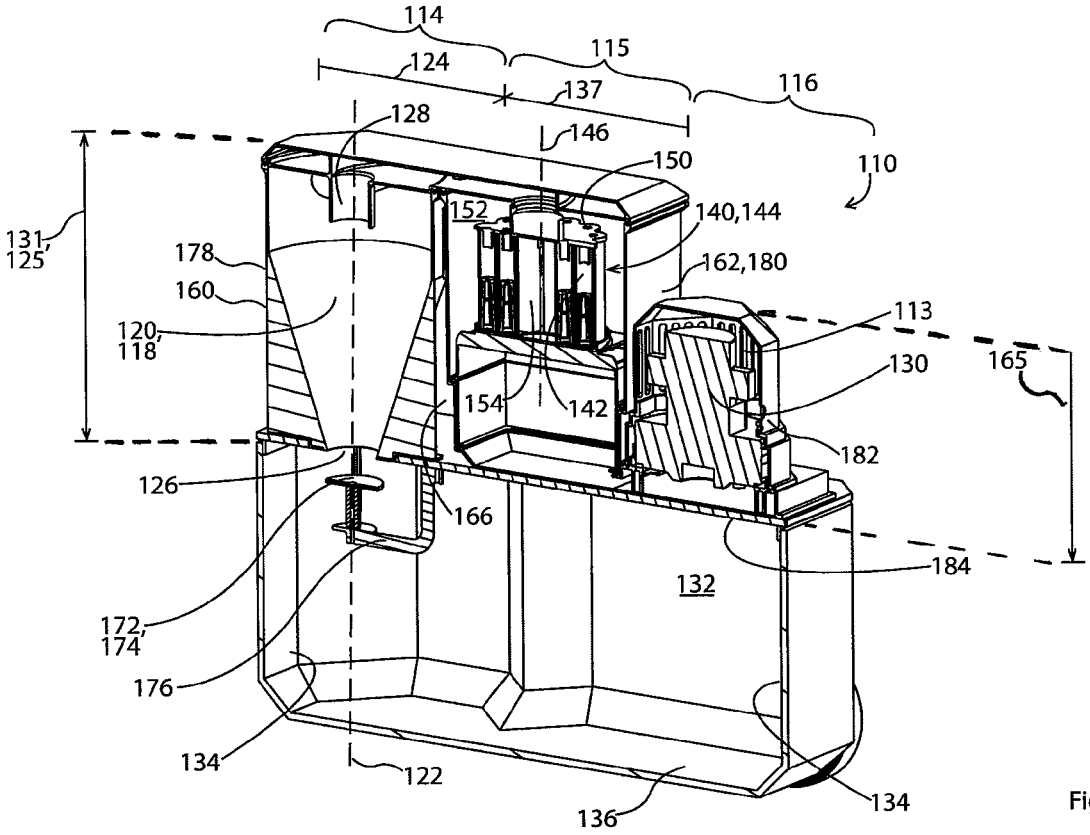
FIG. 8 is a section view of the apparatus of FIG. 7, taken along the line 8-8.

Referring now to FIGS. 2, 6, and 8, the first component 114 comprises a cyclonic cleaning stage 118 comprising a single cyclone 120. The cyclone 120 has a dirt outlet 126 and an air outlet 128. In the examples illustrated, the cyclone 120 extends along a first longitudinal axis 122. The first component 114 has a maximum first component width 124 corresponding to the maximum lateral extent of the first component 114, perpendicular to the first axis 122. This width corresponds to a maximum cross sectional area in a direction transverse to first longitudinal axis 122. The first component 114 has an axial extent or height 125 parallel to the first axis 122.

The apparatus 110 further comprises a dirt collection chamber 132 positioned below the dirt outlet 126. In the example illustrated, the dirt collection chamber 132 is at least partially bounded by sidewalls 134 extending downwardly, a top wall 184 that extends between sidewalls 134, and a floor 136 that extends between the sidewalls 134, and preferably spaced apart from the dirt outlet 122.

The second component 115 is laterally spaced from and disposed laterally adjacent the first component 114. That is, the first 114 and second 115 components are side-by-side. The second component 115 has a lateral extent or width 137 (measured perpendicular to the first axis 122), and a vertical extent or height 131 (parallel to the first axis 122). Preferably, second component 115 has a longitudinal axis that is generally parallel to first longitudinal axis 122. However, it will be appreciated that is may be at an angle to first longitudinal axis 122.

Figure 3:
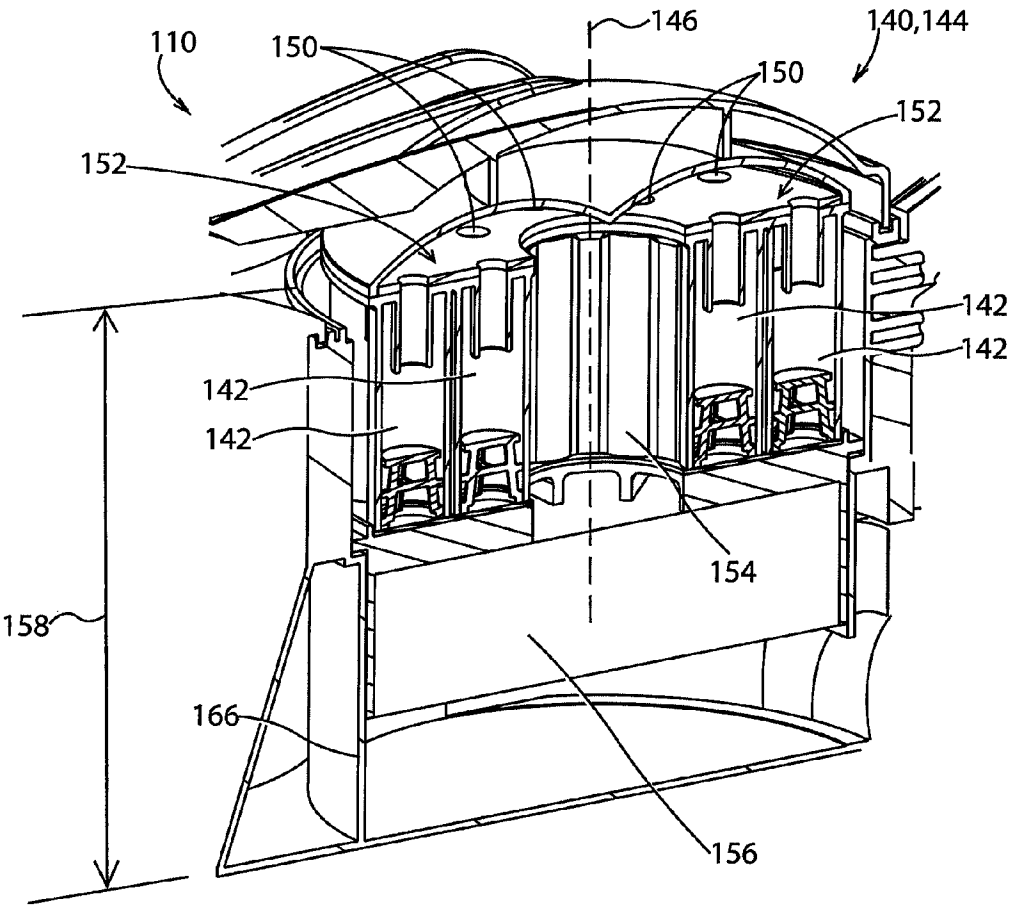
FIG. 3 is an enlarged portion of the apparatus of FIG. 2.

In some embodiments, as shown in FIGS. 3 and 8, the second component 115 may comprise at least one additional cleaning stage 140. The at least one additional cleaning stage 140 preferably comprises at least one second cyclone 142 and, as shown in the example illustrated, more preferably comprises a plurality of second cyclones 142 in parallel. The plurality of cyclones 142 are arranged in parallel, and may be a multi-cyclone assembly 144. The multi-cyclone assembly 144 has, in the examples illustrated, a generally cylindrical configuration with a second axis 146 and a lateral extent 137 (FIG. 2). The second axis 146 is, in the example illustrated, parallel to, and laterally offset from, the first axis 122. In the example illustrated, the additional cleaning stage 140 has an axial extent or height 158 that is about equal to and coterminous with the axial extent 125.

Each of the second cyclones 142 in the assembly 144 receives air from the air outlet 128 of the first cyclone 120, and discharges air through outlets 150 into a manifold 152. Air is evacuated from the manifold 152 through a conduit 154 disposed centrally of the assembly 144. From the conduit 154 the air is drawn towards the motor 130 and expelled from the apparatus 110 through the exhaust 113.

Alternately, or in addition, as shown in FIG. 3, the additional cleaning stage 140 may include a filter element 156, such as a foam membrane, disposed in the fluid stream between the assembly 144 and the motor 130.

In the embodiments shown in FIGS. 2 and 8, surface cleaning apparatus 110 comprises a third component 116, disposed laterally adjacent second component or housing 115. In the embodiments shown, third component 116 comprises a motor housing 182, which houses motor 130. In the embodiment of FIG. 2, motor 130 extends transverse to first longitudinal axis 122, and has an axial extent 163 (parallel to axes 122 and 146) that is, in the example illustrated, about equal to the axial extents 125 and 158 of the first and second cleaning stages 120, 140, respectively. In the embodiment of FIG. 6, motor 130 extends parallel to first longitudinal axis 122, and has a longitudinal extent 165 (parallel to axis 122) that is, in the example illustrated, the same as the axial extent 125 of the first cleaning stages 120. In the embodiment of FIG. 8, motor 130 extends parallel to first longitudinal axis 122, and has a longitudinal extent 165 (parallel to axes 122 and axis 146) that is, in the example illustrated, less than the axial extent 125 of the first cleaning stages 120.

The third component 116 (i.e. motor 130), in the examples illustrated in FIGS. 2 and 8, has a portion that abuts or is adjacent at least a portion of the dirt chamber 132. In this preferred configuration, the components or housings extend linearly. It will also be appreciated that third component may be adjacent both the first and second housings 114 and 115, thereby defining a generally triangular configuration in top plan view.

Figure 4:
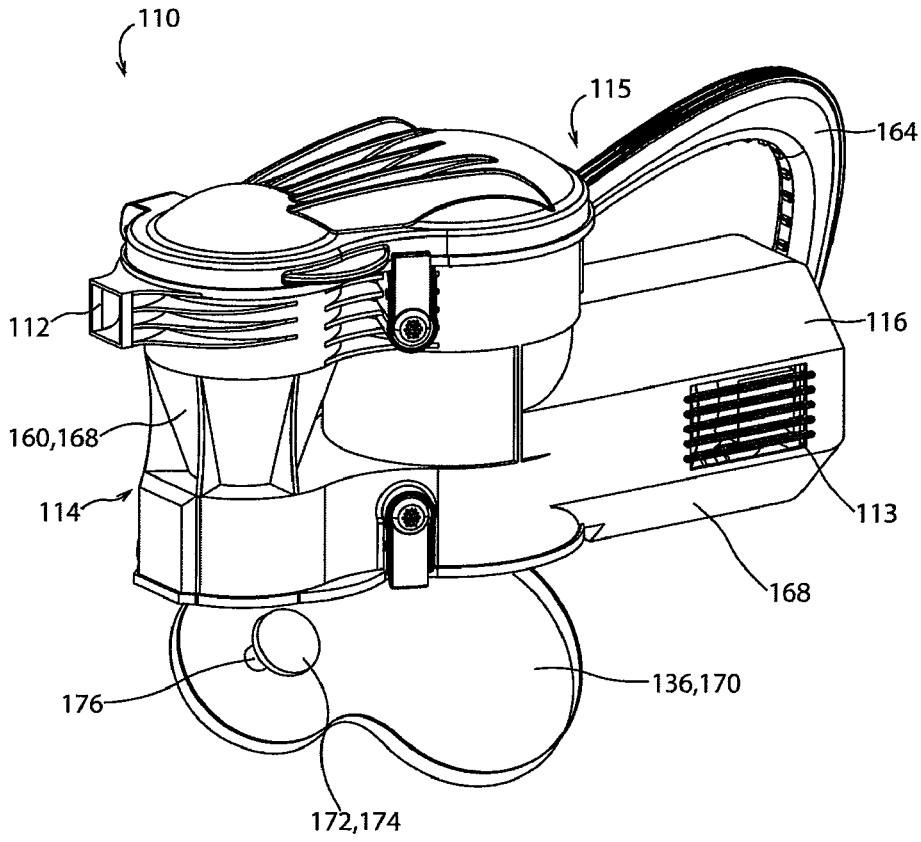
FIG. 4 is a perspective view of the apparatus of FIG. 1 showing a movable element in an open position.
Figure 5:
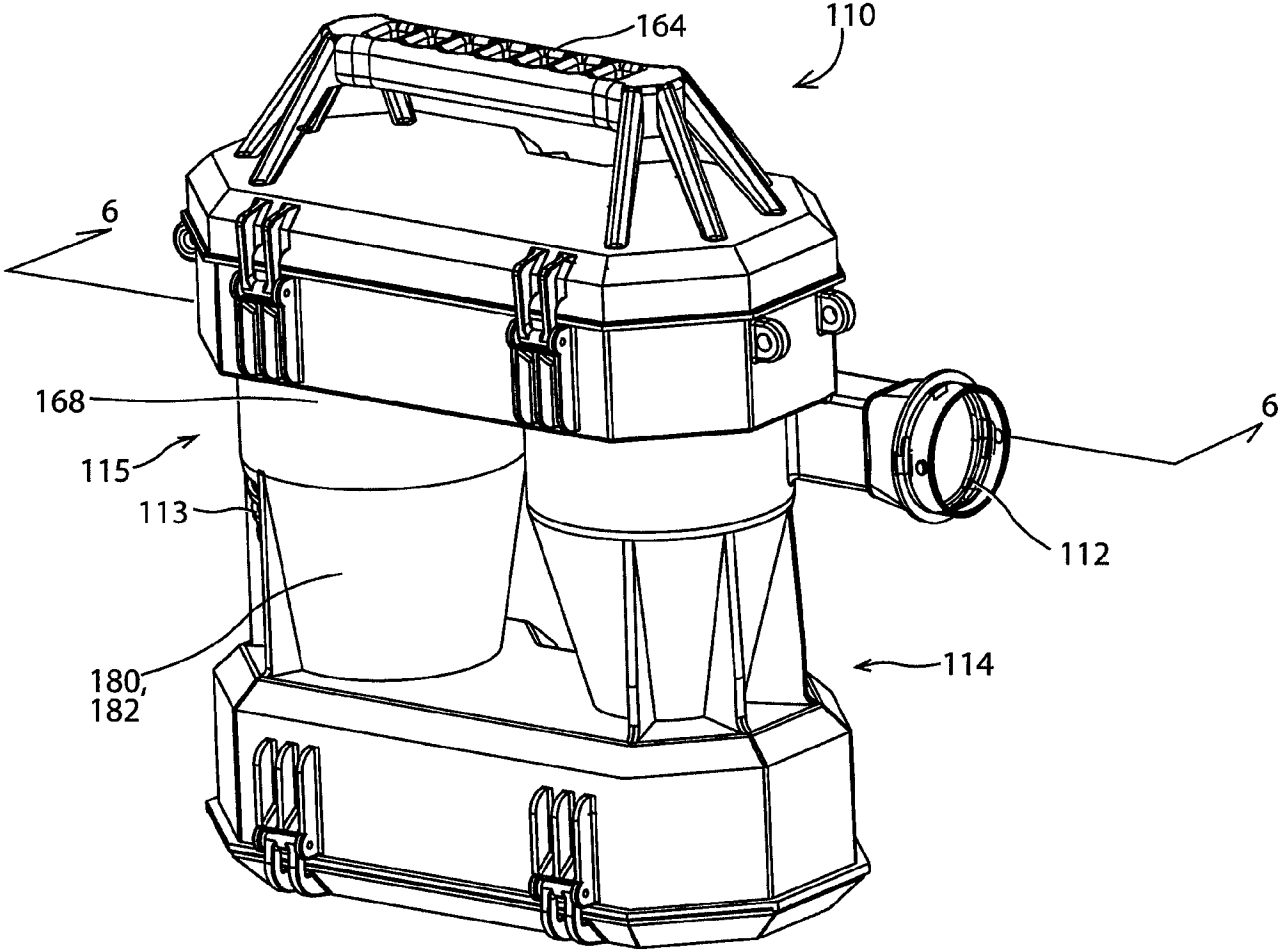
FIG. 5 is a perspective view of another example of a surface cleaning apparatus in accordance with the instant invention; and, FIG. 6 is a section view of the apparatus of FIG. 5, taken along the line 6-6.

In an alternate embodiment, as shown in FIGS. 5 and 6, surface cleaning apparatus 110 may not comprise a third component, and the second component 115 may comprise motor 130. Motor 130 is laterally spaced from the first cyclonic cleaning stage 120. In the embodiment shown, the first component 114 includes a first cyclonic cleaning stage 118 and a second cleaning stage 140 disposed above and in axial registration with the first cleaning stage 120. The first axis 122 of the first cleaning stage 118 (comprising a first cyclone 120) is collinear with the second axis 146 of the second cleaning stage 140 (comprising a plurality of second cyclones 142 arranged in parallel). In will be appreciated that the first component 114 may have only one cyclonic cleaning stage. Further, the first, or only, cyclonic cleaning stage may comprise one or more cyclones, but preferably comprises a single cyclone. In any such embodiment, the motor may be positioned in any configuration. For example, it may extend transverse to the first longitudinal axis 122 as shown in the embodiment of FIGS. 1-4 but preferably extends generally parallel to first longitudinal axis 122 as shown in FIG. 6.

In some embodiments, each of the first and second components may comprise a housing. That is, first component 114 may comprise a first housing 178, and second component 115 may comprise a second housing 180. The first and second housings may be side-by-side. In the embodiments shown, the first component 114 has a first outer wall 160, which forms a first housing 178 for cyclone 120. In the embodiments of FIGS. 1-4 and 7-9, second component 115 comprises additional cleaning stage 140, which has a second outer wall 162, which forms a second housing 180 for additional cleaning stage 140. In these embodiments, the motor is further housed in a third housing 116, which comprises motor housing 182. In the embodiments of FIGS. 5 and 6, wherein second component 115 comprises motor 130, second housing 180 comprises motor housing 182.

In some embodiments, at least one of the first and second outer walls 160, 162 may comprise a wall of a cyclone. For example, the first outer wall 160 of the first component 114 is the outer wall of the first cyclone 120. It will be appreciated that if the second component had a cyclonic stage comprising a single cyclone, then outer wall 162 could be the entire outer wall of such a cyclone. Preferably, as exemplified, first and second components 114, 115 are delineated by a common wall, such as a web 166 (FIGS. 2 and 8) that forms a common portion of both the first outer wall 160 and the second outer wall 162.

At least portions of one or more of housings 178, 180, 182 preferably form a portion of a casing member 168 for the apparatus 110 that is of a unitary, integral construction. For example, casing member 168, which may comprise the outer wall of the housing of all of the cleaning stages in the first and second components, may be integrally molded.

Figure 7:
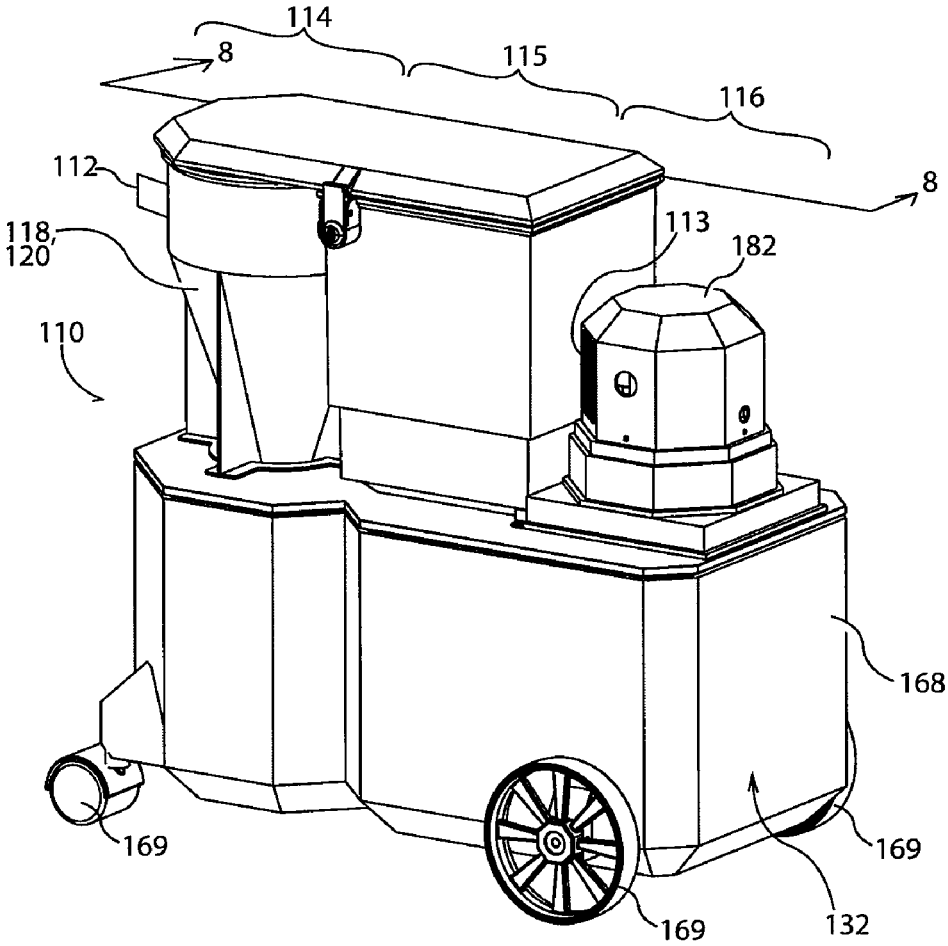
FIG. 7 is a perspective view of another example of a surface cleaning apparatus, which is a wet/dry vacuum cleaner, in accordance with the instant invention.
Figure 9:
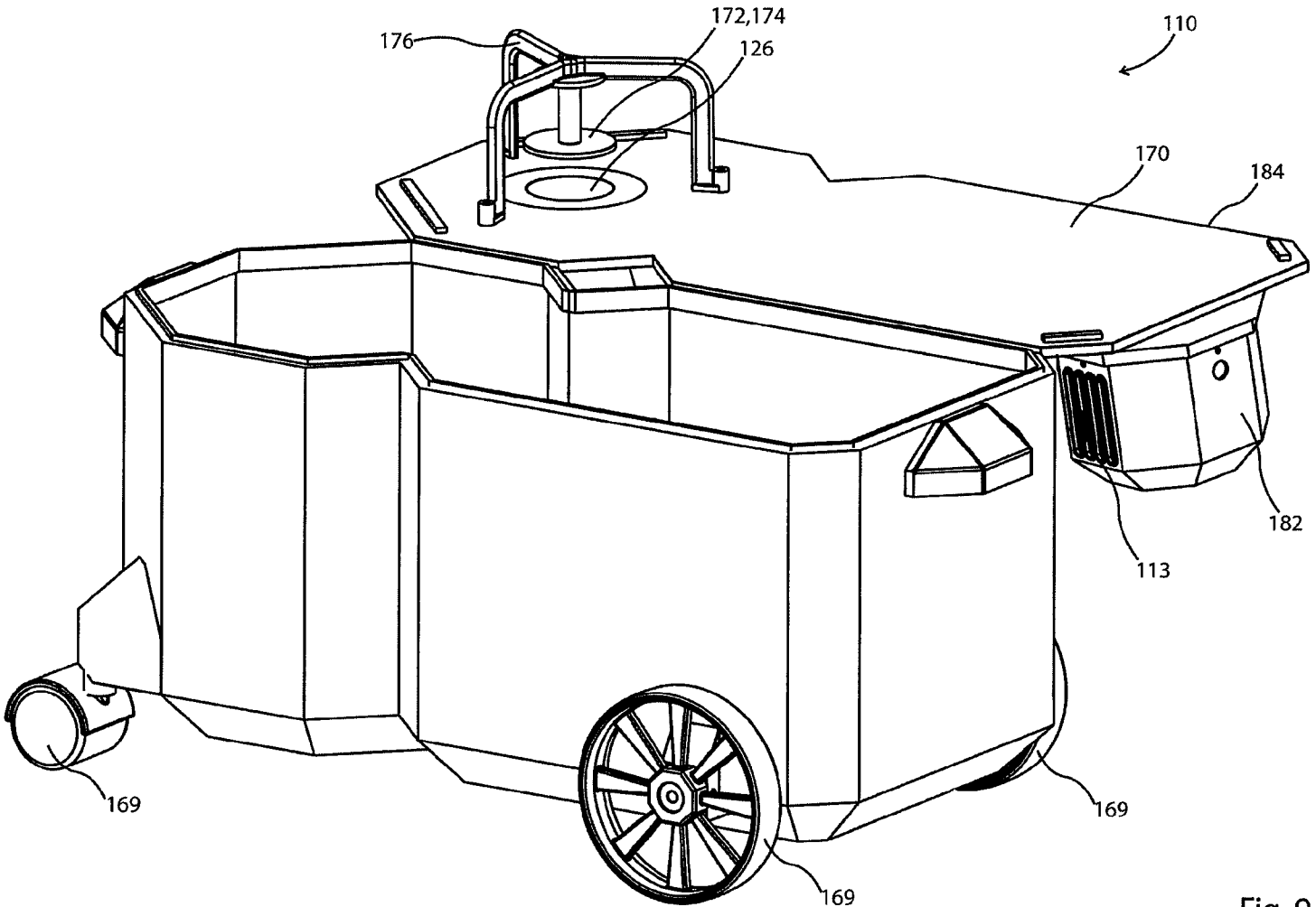
FIG. 9 is a perspective view of the apparatus of FIG. 7 showing a movable element in an open position.

Referring now to FIGS. 2, 6, and 8, the dirt collection chamber 132 extends under at least a portion of the first and second components 114 and 115. In the examples illustrated, the dirt collection chamber 132 extends under all of first component 114 and all of second component 115. That is, in the embodiments of FIGS. 1-4, dirt collection chamber 132 extends under all of the first housing 178, which houses the first cleaning stage, and all of the second housing 180, which houses second cleaning stage 140. In the embodiment of FIGS. 5 and 6, dirt collection chamber 132 extends under all of the first housing 178, which houses first cleaning stage 120 and second cleaning stage 140, and all of the second housing 180, which comprises motor housing 182. In the embodiment of FIGS. 7-9, dirt collection chamber 132 extends under all of the first housing 178, which houses the first cleaning stage, and all of the second housing 180, which houses second cleaning stage 140, and further extends under the third component 116, which comprises motor 130 housed in housing 182. In alternate embodiments, the dirt collection chamber 132 may extend under a portion of first component 114 and a portion of second component 115 or under only a portion of one of first and second components 114, 115 and under all of the other of first and second components 114, 115. For example, the dirt collection chamber 132 may extend under all of first component 114, and at least half of the second component 115.

In the embodiments shown, the horizontal cross section of dirt collection chamber 132 has a cross-sectional area that is larger than the cross sectional area of the first housing 178. That is, referring to FIG. 2, wherein the first housing extends vertically along axis 122, the cross-sectional area of the dirt collection chamber 132 in a plane perpendicular to axis 122 is larger than the cross-sectional area of the first housing in a plane perpendicular to axis 122.

Referring to FIGS. 4 and 9, the dirt chamber 132 preferably has an openable panel 170 to facilitate emptying debris collected therein. In the embodiment of FIG. 4, panel 170 comprises floor 136, which is movable between open and closed positions. The floor 136 is preferably pivotally mounted to at least one of the first and second components 114, 115. In the embodiment of FIG. 9, panel 170 comprises a top wall 184 of dirt chamber 132, on which first 114 and second 115 components are positioned. In other embodiments, dirt collection chamber 132 may be emptyable by any means known in the vacuum cleaner art. For example, dirt collection chamber 132 may be removably mounted to the surface cleaning apparatus or otherwise openable.

The apparatus 110 may also include a divider plate positioned adjacent the dirt outlet 126 of the first cyclone 120. In the example illustrated, the divider plate 172 is positioned within the dirt chamber 132, adjacent to but spaced below the dirt outlet 126. The divider plate 172 may generally comprises a disc 174 that has a diameter slightly greater than the diameter of the dirt outlet 126, and disposed in facing relation to the dirt outlet 126. The disc 174 is, in the example illustrated, supported by a pedestal 176. In the embodiment of FIG. 4, pedestal 176 extends upwardly from the floor 136 of the dirt chamber 132. In the embodiment of FIG. 9, pedestal 176 extends downwardly from top wall 184 of dirt chamber 132. Alternately, plate 172 may be mounted to a sidewall 134 of the dirt collection chamber 132.

In the embodiments of FIGS. 1-6, the surface cleaning apparatus may be carried by a strap (not shown) or by using handle 164. In the embodiments of FIGS. 7-9, the surface cleaning apparatus may comprise one or more wheels 169, glides, or the like, for moving surface cleaning apparatus 110 along a surface.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

The invention claimed is:

1. A surface cleaning apparatus comprising:

(a) a dirt inlet, a clean air outlet and a fluid flow path extending between the dirt inlet and the clean air outlet;

(b) first and second side by side housings, the first housing comprising a cyclonic cleaning stage in the fluid flow path comprising a cyclone having a dirt outlet, a divider plate positioned adjacent the dirt outlet of the cyclone and a cyclone axis;

(c) an associated dirt collection chamber extending under at least a portion of the first and second housings and having a door that is openable, and the divider plate is mounted to the door; and, (d) a fluid flow motor in the fluid flow path and having a motor axis.

2. The surface cleaning apparatus of claim 1 wherein the dirt collection chamber extends under at least half of the second housing.

3. The surface cleaning apparatus of claim 1 wherein the dirt collection chamber extends essentially under all of the second housing and essentially under all of the first housing.

4. The surface cleaning apparatus of claim 1 wherein when the first housing extends vertically, a horizontal cross section of the dirt collection chamber has a cross sectional area that is larger than a horizontal cross section of the first housing.

5. The surface cleaning apparatus of claim 1 wherein the second housing houses at least one member selected from the group comprising at least one additional cleaning stage and the fluid flow motor.

6. The surface cleaning apparatus of claim 5 wherein the at least one additional cleaning stage comprises at plurality of cyclones.

7. The surface cleaning apparatus of claim 1 further comprising a third housing that houses the motor.

8. The surface cleaning apparatus of claim 1 wherein the first housing houses at least an additional cyclonic cleaning stage, and wherein at least one of the cyclonic cleaning stage and the additional cyclonic cleaning stage comprises a plurality of cyclones in parallel.

9. The surface cleaning apparatus of claim 1 wherein each of the first and second housings have an outer wall and the outer wall of at least one of the housings comprises a wall of a cyclone.

10. The surface cleaning apparatus of claim 1 wherein the first and second housings have a common wall.

11. The surface cleaning apparatus of claim 1 wherein the first and second housings are integrally molded.

12. The surface cleaning apparatus of claim 1 wherein the door comprises a floor of the dirt collection chamber and the floor is pivotally mounted to at least one of the first and second housings.

13. The surface cleaning apparatus of claim 1 wherein the cyclonic cleaning stage comprises a single cyclone having the dirt outlet.

14. The surface cleaning apparatus of claim 1 wherein the surface cleaning apparatus comprises a hand or strap carryable vacuum cleaner.

15. The surface cleaning apparatus of claim 1 wherein the first and second housings are laterally spaced apart.

16. A surface cleaning apparatus comprising:

(a) a dirt inlet, a clean air outlet, and a fluid flow path extending between the dirt inlet and the clean air outlet;

(b) a fluid flow motor in the fluid flow path having a motor axis;

(c) a cyclonic cleaning stage in the fluid flow path and having a cyclone axis, the cyclonic cleaning stage being laterally spaced from the fluid flow motor, the cyclonic cleaning stage comprising a cyclone having a dirt outlet;

(d) an associated dirt collection chamber extending under at least a portion of the cyclonic cleaning stage and the fluid flow motor, the associated dirt collection chamber having an openable door; and, (e) another cyclonic cleaning stage positioned above the cyclonic cleaning stage and comprising a plurality of cyclones in parallel.

17. The surface cleaning apparatus of claim 16 wherein the dirt collection chamber extends essentially under at least all of the fluid flow motor.

18. The surface cleaning apparatus of claim 16, wherein the cyclonic cleaning stage is housed in a first housing and the fluid flow motor is housed in a second housing.

19. The surface cleaning apparatus of claim 16, wherein the surface cleaning apparatus is one of a hand or strap carryable vacuum cleaner.

20. The surface cleaning apparatus of claim 1, wherein the second housing houses the fluid flow motor and the cyclone axis is generally parallel to the motor axis.

21. The surface cleaning apparatus of claim 16, wherein the cyclone axis is generally parallel to the motor axis.

* * * * *